United States Patent [19]

Basnett

[11] Patent Number: 4,504,808

[45] Date of Patent: Mar. 12, 1985

[54] VACUUM CONTACTOR KICKOUT SPRING ADJUSTMENT APPARATUS

[75] Inventor: Robert T. Basnett, Hendersonville, N.C.

[73] Assignee: Westinghouse Electric Corp., Pittsburgh, Pa.

[21] Appl. No.: 486,590

[22] Filed: Apr. 19, 1983

[51] Int. Cl.[3] ..... H01H 9/02; H01F 7/08

[52] U.S. Cl. ..... 335/154; 335/132; 335/274

[58] Field of Search ..... 335/151, 152, 153, 154, 335/273, 274; 200/144 B

[56] References Cited

U.S. PATENT DOCUMENTS 2,323,702 7/1943 Berkey ..... 335/151

2,585,684 2/1952 Roggenstein ..... 335/274

*Primary Examiner*—E. A. Goldberg

*Assistant Examiner*—George Andrews

*Attorney, Agent, or Firm*—John Victor Pezdek

[57] ABSTRACT

A vacuum contactor kickout spring adjustment apparatus providing for the controllable increase or decrease in the force of the kickout spring. The apparatus permits the insertion or removal of the kickout spring at a force substantially less than the normal operating force of the spring. The apparatus includes a base having a U-shaped bracket mounted thereto. Rotatively mounted intermediate the legs of the bracket is a locking block. A lever pivotally mounted on the base engages one end of the kickout spring. A rod engages the locking block and lever such that movement in one direction moves the lever to increase the force and the spring while the movement of the rod in the opposite direction accuses a decrease in the force of the spring.

16 Claims, 5 Drawing Figures

VACUUM CONTACTOR KICKOUT SPRING ADJUSTMENT APPARATUS

CROSS-REFERENCE TO RELATED APPLICATIONS

The material presented herein is related the material presented in the following copending patent applications: Ser. No. 486,584, filed Apr. 19, 1983, entitled "Vacuum Contactor Having DC Electromagnet with Improved Force Watts Ratio;" Ser. No. 486,588, filed Apr. 19, 1983, entitled "Mechanical Interlock Mechanism For A Vacuum Contactor;" Ser. No. 486,589, filed Apr. 19, 1983, entitled "Contact Overtravel Adjustment Apparatus for a Vacuum Contactor."

BACKGROUND OF THE INVENTION

1. Field of the Invention

In general, the invention relates to vacuum contactors employing vacuum interrupters and in particular to the means employed to install and adjust the kickout spring used to open the vacuum contactor.

2. Description of the Prior Art

There are many designs of vacuum interrupters in existence. U.S. Pat. No. 4,002,867, issued Jan. 11, 1977 entitled "Vacuum Type Circuit Interrupters With a Condensing Shield at a Fixed Potential Relative to the Contact" is a representative example of such vacuum interrupters. An operating mechanism combined with one, two or three vacuum interrupters constitutes a vacuum contactor. In contradistinction to circuit breakers which are considered as principal protective devices during fault conditions in an electrical circuit and are designed for 20,000 to 50,000 operations, the vacuum contactor is used to start and stop various electric loads in response to signals generated by control devices such as push button switches, limit switches, and programmable controllers with the vacuum contactor being designed to have a lifetime of 2 to 3 million operations.

The main difference between vacuum contactors and conventional air break contactors is that the vacuum interrupters of the vacuum contactor break or interrupt the electric current inside a vacuum chamber instead of inside an air arc box. The vacuum chamber for the vacuum interrupter consists of a unit assembly of a sealed evacuated enclosure surrounding a fixed or stationary electrical contact and a moveable electrical contact. A portion of the moveable contact extends through a gas-tight metallic bellows which allows for the essentially linear motion of the moveable contact with respect to the stationary contact. The bellows is attached to the evacuated chamber by means of an end cap seal. Another end seal is provided for attaching the stationary contact to the enclosure. A ceramic sleeve or cylinder is provided to separate and electrically isolate the two contacts. The end seals are attached to the ends of the ceramic sleeve forming the evacuated chamber of the vacuum interrupter.

Because vacuum interrupters are normally closed by atmospheric pressure and an auxiliary contact spring, means must be provided to force the contacts into the open position which is the normal state for a deenergized contactor. The actual contact force holding the moveable and stationary contacts together inside each vacuum interrupter is the sum of the atmospheric force (atmospheric pressure times the mean area of the bellows) plus the force provided by the auxiliary contact spring and the mechanical spring force exerted by the bellows. This auxiliary contact spring force increases the total force sufficiently to sustain closure of the contacts during high short circuit currents that tend to blow the contacts apart. In the deenergized condition, there is no electrical energy available to provide the force necessary to separate the contacts. Instead, one or more mechanical springs provide this contact opening force. In practice this spring, called the kickout spring, exerts sufficient force to maintain the contacts in the open position in a deenergized contactor. To close the contacts of the vacuum interrupter on command, an electromagnet is provided that when energized, will pull the operating mechanism closed, overcoming the force of the kickout spring and closing the contacts of the vacuum interrupter.

One problem with typical vacuum contactors is the safe installation and adjustment of the kickout spring. The stored force in the spring, over 100 pounds in some cases, is potentially hazardous if the spring slips loose during installation or removal. Presently, control of the force in the spring during maintenance is somewhat haphazard. Existing designs compress the kickout spring between a moveable linkage and a plate secured to a base by fasteners such as screws or bolts. In order to remove the spring, the bolts or screws are loosened to relieve some of the force of the spring. However, the fasteners must usually be removed from the base before the force of the spring is reduced to an easily manageable level. Should the plate slip, the spring may cause injury to maintenance personnel. Similarly, in order to install the spring, it must be sufficiently compressed to allow the fasteners to engage the base. Again, should the fastener slip, the spring may cause injury to maintenance personnel. Thus, an adjusting means which can provide for the controllable increase or decrease in the force of the kickout spring would be advantageous.

SUMMARY OF THE INVENTION

In general, the invention relates to a combination of a vacuum contactor and a kickout spring adjustment apparatus providing for the controllable increase or decrease in the force of the kickout spring used to open the vacuum contactor. The vacuum contactor is one or more vacuum interrupters, each having a stationary contact and a moveable contact, in combination with an operating mechanism which is connected to the moveable contact of each of the interrupters that are present. The operating mechanism opens and closes the vacuum interrupter or interrupters in response to a control signal. Included in the operating mechanism are a kickout spring and an electromagnet which are mechanically linked to the moveable contacts of the vacuum interrupters and are used provide the forces necessary to open and close, respectively, the contacts of the interrupters. The contacts are enclosed in an evacuated chamber having a substantially gas-tight opening through which a portion of the moveable contact extends. Connected to this extension of the moveable contact is a shaft which rotates about its longitudinal axis through an arc of about 4 degrees as the moveable contact moves between the open and closed positions. A housing is provided for supporting the shaft, the operating mechanism, and the vacuum interrupter or interrupters.

A kickout spring adjustment means provides for the controllable increase or decrease in the force of the spring. This allows for the insertion or removal of the kickout spring in the operating mechanism at a force substantially lower than the operating force of the spring. Provided in the adjustment mechanism are:

a base;

a U-shaped bracket mounted on the base adjacent the spring and having opposed bores in the legs thereof;

a locking block intermediate the legs of the bracket and inserted in the opposed bores of the bracket;

a lever having a portion thereof in contact with one end of the spring and having one end thereof moveably mounted in the base; and a rod having a shaft and a head, the shaft engaging the locking block, the head engaging the lever with the rod, locking block, bracket and base holding the lever against the force of the spring. The movement of the rod in one direction moves the lever to increase the force of the spring while movement in the opposite direction moves the lever to decrease force of the spring. The rod and bore in the locking block can be threaded allowing a screwdriver to be used to make the adjustment in the force of the spring. A second threaded bore in the locking block and a set screw can be used to lock the position of the rod against vibrations caused by the operation of the vacuum contactor.

The present invention effectively controls the force contained in the kickout spring minimizing the possible hazards associated with spring installation or removal. The invention also provides a convenient means to adjust spring force to account for wear and aging of the vacuum contactor over its operating lifetime. Further, when the vacuum contactors are installed at high elevations above sea level, adjustment of the spring force is also required due to the decrease in the atmospheric pressure available to close the contacts. With the present invention this adjustment can be conveniently made.

BRIEF DESCRIPTION OF THE DRAWINGS

For a better understanding of the invention, reference may be made to the preferred embodiments exemplary of the invention shown in the accompanying drawings wherein.

DESCRIPTION OF THE PREFERRED EMBODIMENTS

Figure 1:
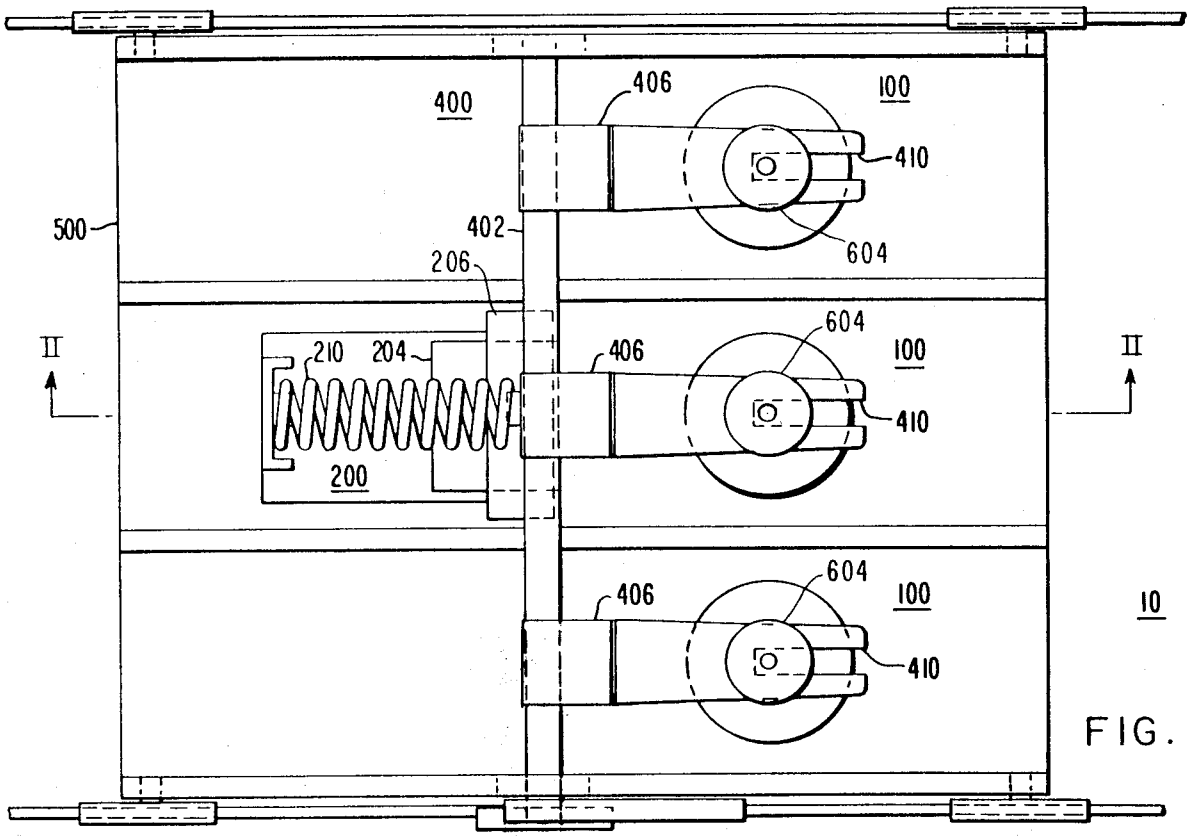
FIG. 1 is a plan view of a vacuum contactor embodying the present invention.
Figure 2:
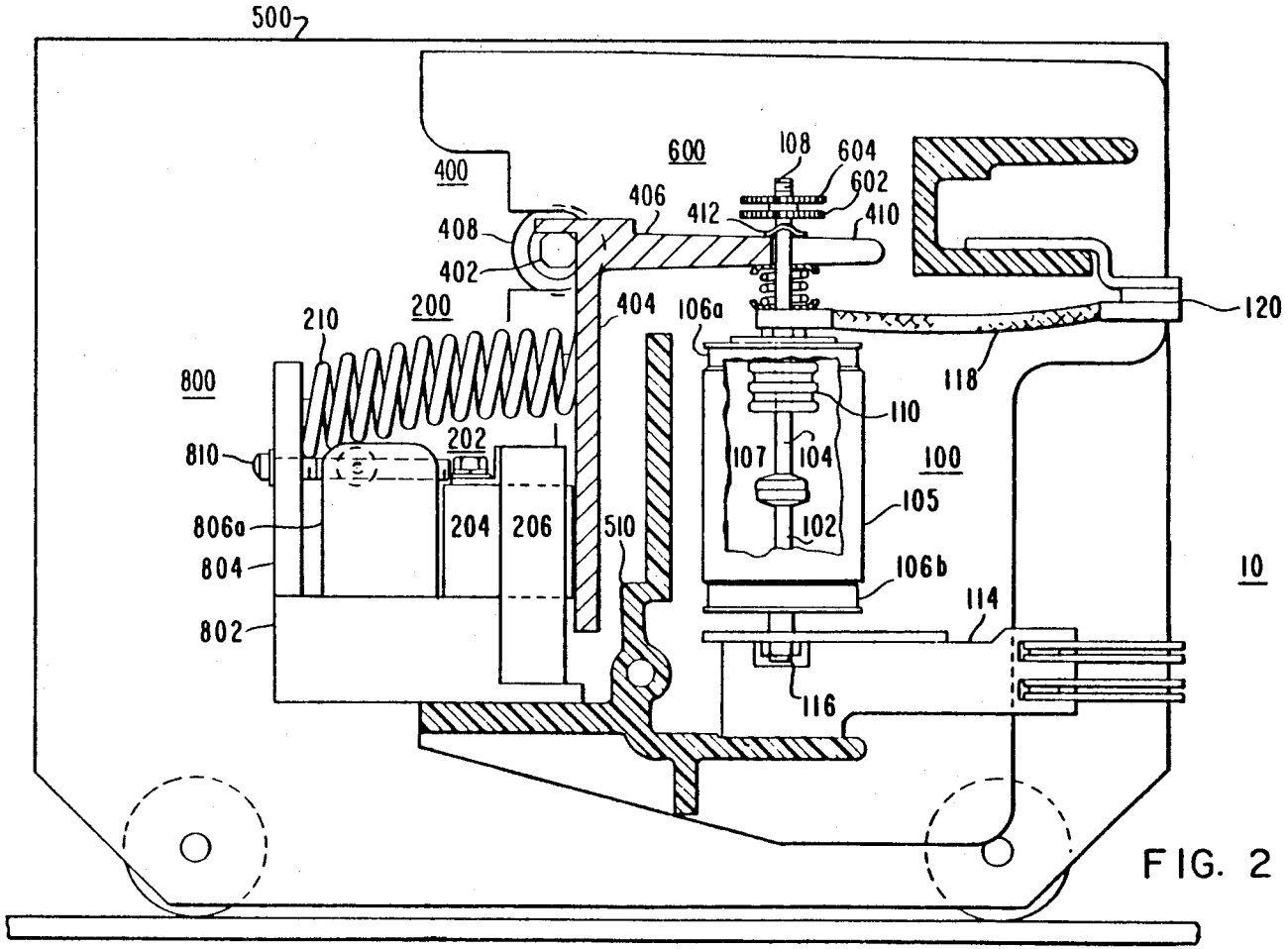
FIG. 2 is a sectional view of the vacuum contactor taken along line II—II of FIG. 1 showing the vacuum contactor in the closed position.
Figure 3:
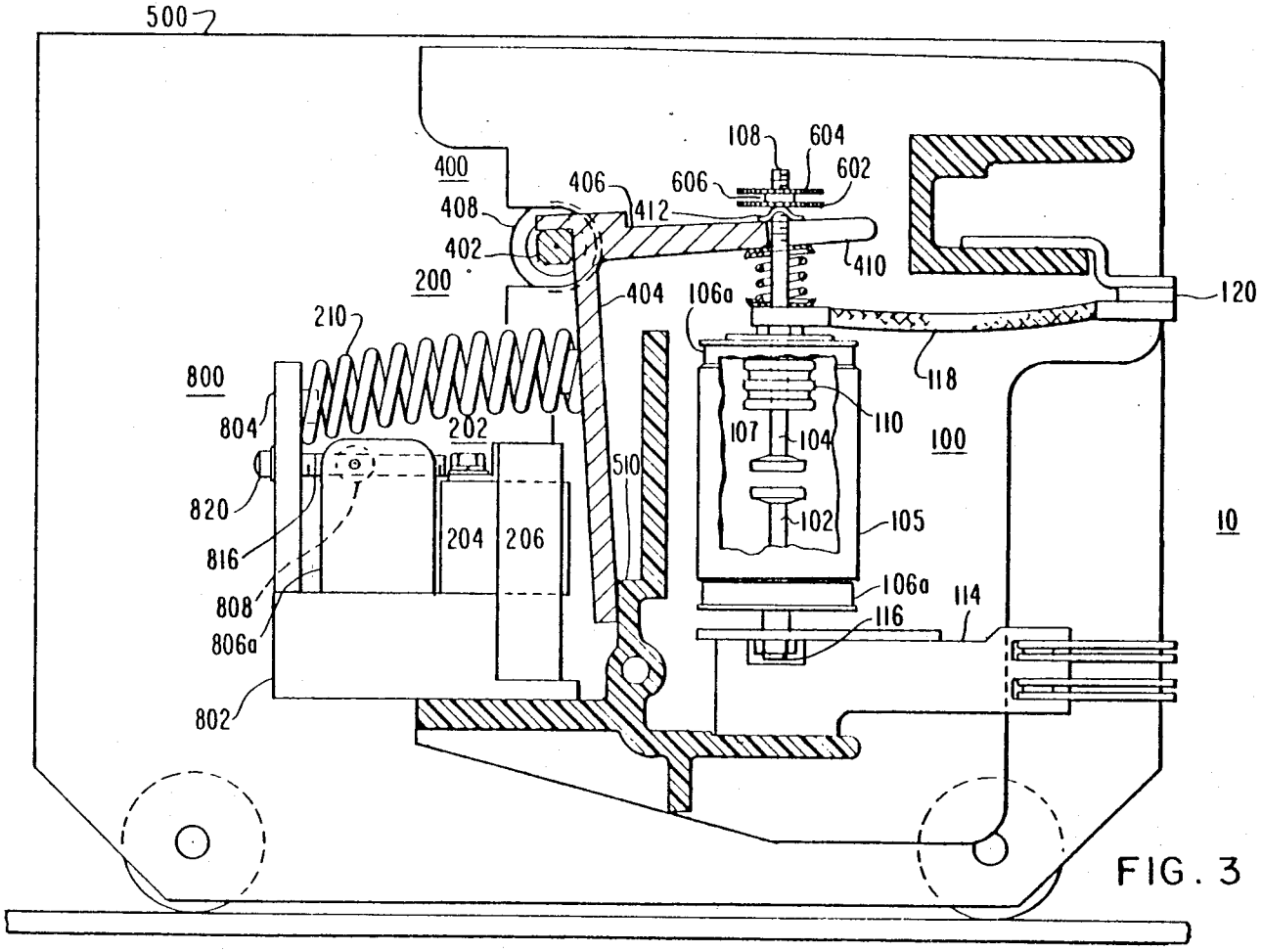
FIG. 3 is a sectional view of the vacuum contactor of FIG. 2 showing the vacuum contactor in the open position.

Referring to FIGS. 1 through 4, a vacuum contactor 10 comprising a vacuum interrupter 100, an operating mechanism 200 for the interrupter 100, and a kickout spring adjustment mechanism 800 is shown. The interrupter 100 includes a stationary contact 102, a moveable contact 104, and an electrically insulating sleeve 105 and two end seals 106*a* and 106*b* forming an evacuated chamber 107 enclosing both contacts. An opening is provided in the chamber 107 through which a portion 108 of the moveable contact 104 extends. The combination of a metallic bellows 110 and the end seal 106*a* provides a gas-tight seal for the opening of the chamber 107 allowing for the linear motion of the moveable contact 104. The stationary contact 102 mounts to the sleeve 105 via end seal 106*b* and connects to an electrically conductive bus 114 via a fastener such as the bolt 116. A flexible electrically conductive shunt 118 is provided between a second bus bar 120 and the extension 108 of the moveable contact 104 thus completing the other side of the circuit. When the contacts are closed, the electric circuit through the second bus bar 120, shunt 118, moveable contact 104, stationary contact 102, and first bus bar 114 is complete. The insulating sleeve 105, usually made of a ceramic material, is necessary in order to maintain the electrical isolation of the moveable contact 104 from the stationary contact 102 when the vacuum interrupter 100 is deenergized in that the stationary contact 102 is usually connected to the source of electrical potential.

The operating mechanism 200 includes an electromagnet 202 that when energized closes the contacts and a kickout spring 210 that opens the contacts when the electromagnet 202 is deenergized. The electrmagnet 202 is a two-piece assembly with a magnetically permeable, U-shaped core 204 and a dual winding assembly 206 having pickup and holding coils (not shown) being disposed about the legs of the core 204. Because of space considerations, the operating mechanism is not axially aligned with the moveable contact 108. Accordingly, a linkage 400 is used between the operating mechanism 200 and the moveable contact 104 to translate the opening and closing forces to the axis of movement of the moveable contact 104. The linkage 400 consists of a shaft 402 that has a radially extending leg 404 and arm 406 and is rotatably supported by means of bearings 408 provided in the housing 500. One arm is provided for each vacuum interrupter in the contactor. The majority of applications require a contactor having 3 poles leading to the use of 3 vacuum interrupters and 3 arms as shown in FIG. 1. However, contactors having other numbers of interrupters can also be constructed.

The leg 404 extends from the shaft 402 adjacent the core 204 of the electromagnet 202, the portion of the leg 404 adjacent the core 204 being magnetically permeable. The arm 406 extends from the shaft 402 to the extension 108 of the moveable contact 104. An opening 410 is provided in the arm 406 to allow the extension 108 to pass therethrough. The size of the opening 410 permits a small degree of misalignment with respect to the contact extension 108. The opening 410 can be either circular or slotted as shown. The slotted opening facilitates removal of the vacuum interrupter 100 when necessary. The portion of the extension 108 projecting beyond the arm 406 is dimensioned such that it is greater than the size of the opening 410. Preferably, however, the extension 108 is threaded allowing a nut 602 to be fastened thereto preventing the withdrawal of the extension 108 from the arm 406. When the contactor is closed, the nut 602 is spaced from the arm 406 forming an overtravel gap g. The nut 602 is locked in this position by the use of a second nut 604 threaded onto the extension 108. A spacing washer 606 can be inserted between the nuts 602 and 604. The overtravel gap g decreases as the contacts 102 and 104 wear. Typically, for a new interrupter this gap is set to be approximately $0.08 \pm 0.005$ inches. Thus, the nuts 602 and 604 serve to indicate contact wear as well as connecting the interrupter to the linkage 400.

A pivot plate 412 can be provided intermediate the nut 602 and the arm 406 in order to facilitate the opening and closing action of the contactor 100. As can be seen from FIGS. 2 and 3, when the contactor 100 changes from closed to open or from open to closed, the arm 406 rotates through a small arc, contacting the nut 602 and moving the contact 104 to the open position. Although the arm 406 could directly engage the nut 602, lateral forces can be transmitted to the bellows 110 via the corresponding arcuate motion of the moveable contact 104. These lateral forces can reduce the operating life of the bellows 110. The pivot plate 412 and the size of the opening 410 assure that the motion of the moveable contact 108 remains linear even though the arm motion is arcuate thereby substantially reducing the application of any lateral force to the bellows 110.

Figure 5:
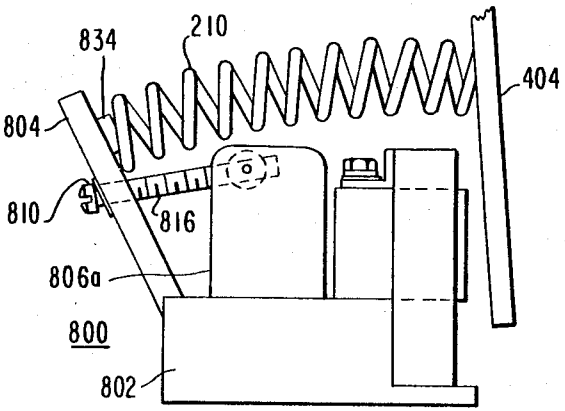
FIG. 5 is an illustration of the installation of a kickout spring in the spring adjustment mechanism of FIG. 4 in a deenergized vacuum contactor.
Figure 4:
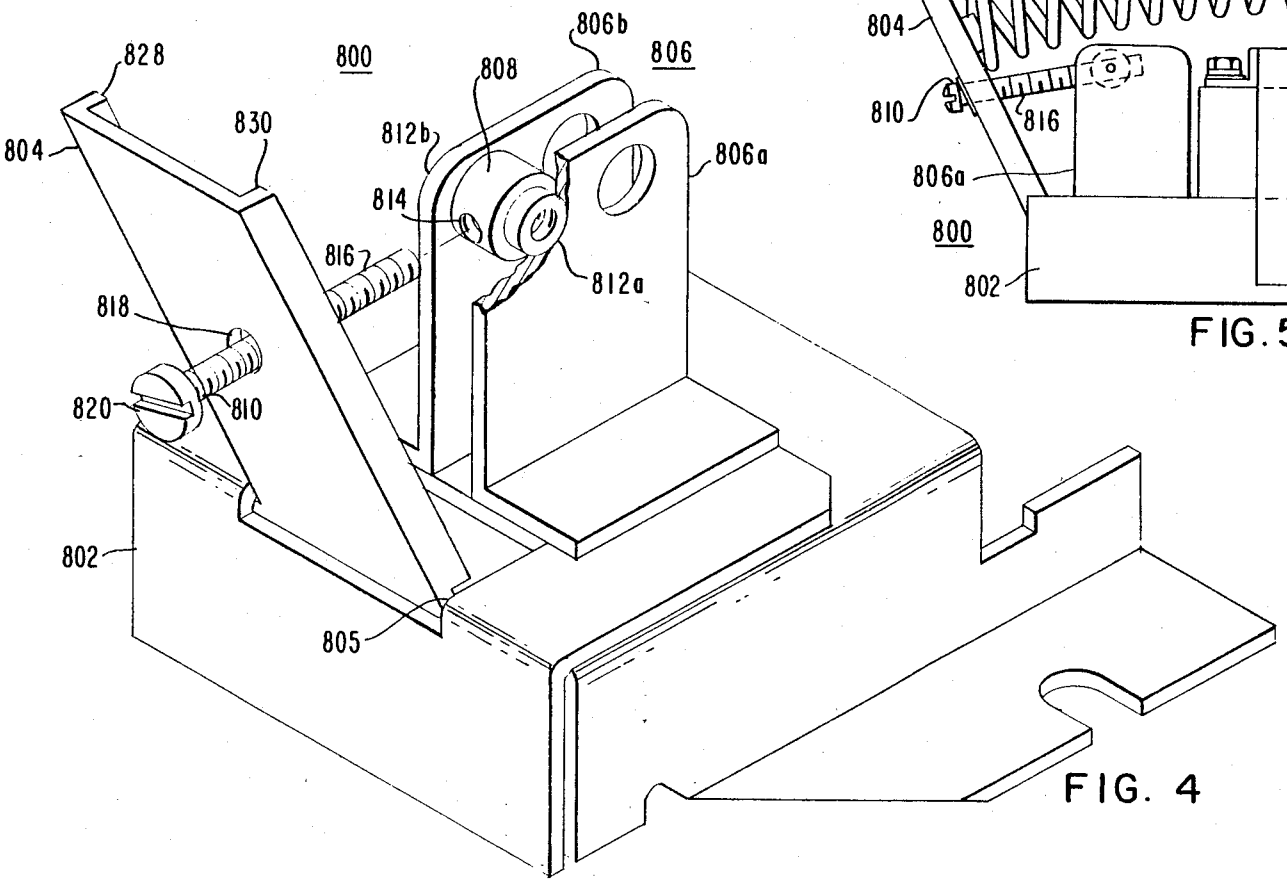
FIG. 4 is an isometric illustration of a spring adjustment mechanism for the vacuum contactor.

Referring to FIGS. 4 and 5, the kickout spring 210 is positioned intermediate the leg 404 and a spring adjusting mechanism 800 including a base 802, a lever 804, a U-shaped bracket 806, a locking block 808, and a rod 810. The lever 804 has one end pivotally mounted to the base 802 with a portion of the lever being in contact with one end of the kickout spring 210. The U-shaped bracket 806 is formed by two L-shaped leg members **806*a* and 806*b* which are secured to the base 802 by fastening means such as self-tapping screws (not shown). Opposed bores 812*a* and 812*b* are provided in the U-shaped bracket 806 for mounting the locking block 808 while allowing for rotation thereof. Bore 814 is provided in the locking block 808 for receiving the shaft 816 of the rod 810. Provided in the lever 804 is a bore 818 corresponding to the bore 814 and through which the shaft 816 of the rod 810 passes. The head 820 of the rod 810 is larger than the opening of the bore 818 in the lever 804, preventing the rod 804** from passing therethrough. A smaller head with a washer can be used to effect the same result.

The shaft 816 and the bore 814 can be threaded such that rotation of the rod 810 about the longitudinal axis thereof in one direction causes the lever 804 to increase the force of the kickout spring 210 while rotation of the rod 810 in the opposite direction causes the lever 804 to decrease the force of the kickout spring 210. The length of the kickout spring 210 changes as the force thereof is increased or decreased moving the lever 804 through an arc with respect to the base 802. The bore 818 is dimensioned so that the rod 810 can follow the movement of the lever 804 with the locking block 808 rotating in the opposed bores **812*a* and 812*b* to accommodate the arcuate movement of the rod 810. The length of the rod 810 is such that the force of the spring 210 is substantially reduced from the normal operating force before the rod 810 disengages from the locking block 808. For example, where normal operating spring force is 100 pounds, spring force with the rod fully extended may be about 10 pounds, an amount which permits easy control of the spring by hand. The spring adjusting mechanism 800 provides for the controllable increase or decrease in the force of the kickout spring 210**.

In order to pivotally mount the lever 804, it is provided with a pair of outwardly extending feet (not shown) at one end 805 and a pair of flanges 828 and 830. An opening 824 in the base 802 receives the footed end 805 of the lever with the feet engaging a portion of the undersurface of the base 802. The flanges 828 and 830 prevent the lever 804 from falling through the opening while the feet prevent the lever 804 from being pulled out of the base 802 during normal operation of the vacuum contactor 10. With this method of attachment, the lever 804 is still free to pivot when necessary. Other forms of attachment such as a tongue and groove wherein the lever slideably engages the base can also be utilized. The flanges 828 and 830 can be provided adjacent the opening 804 or along the entire length of the lever 804. This latter embodiment also acts to strengthen the lever 804.

A spring seat 834 can be provided on the lever 804 for holding the end of the kickout spring adjacent the lever 804. The seat 834 prevents the kickout spring from slipping out from between the lever 804 and the leg 404 as the force thereof is adjusted. The spring seat can be formed by the head of a bolt threaded into the lever, or a bore having a diameter slightly greater than that of the kickout spring can be drilled in the lever. A second spring seat can be provided on the leg 404 for the other end of the kickout spring.

In a further embodiment of the kickout spring adjustment mechanism 800, the locking block has a second threaded bore (not shown) therein intersecting the first bore 814. A set screw (not shown) is threaded into the second bore of the locking block 808 hitting the shaft 816 of the rod 810 which is engaged with the first bore 814. This locks the rod 810 in the locking block 808 preventing further adjustment and securing the rod 810 against vibrations caused during the opening and closing of the vacuum contactor 10.

When the electrmagnet 202 is energized in response to a control signal generated by a control device such as a pushbutton switch, the magnetic flux created exerts a pull upon the magnetically permeable portion of the leg 404 drawing the leg 404 into contact with the core 204 of the electromagnet 202, compressing the kickout spring 210, and rotating the leg 404 and shaft 402 through an arc. The arm 406 is also rotated in the same direction allowing the atmospheric force upon the bellows 110 to transfer the moveable contact 104 to the closed position (see FIG. 2). An auxiliary spring 130 can be provided intermediate the arm 406 and the chamber 106 to provide additional closing force. Because the amount of contact travel is in the range of 0.1 to 0.2 inches, the amount of rotation of the leg, shaft, and arm is in the range of 3 to 4 degrees.

When the electromagnet 202 is deenergized, the kickout spring 210 acts upon the leg 404 providing sufficient force to overcome any residual magnetic attraction between the leg 404 and the electrmagnet 202 rotating the leg 404 and shaft 402 back to their original positions. This in turn rotates the 406 arm lifting the nut 602; thus, transferring the moveable contact 104 to the open position. The opening 410 in the arm 406 is made such that the moveable contact 104 follows a linear path even though, the leg 404, arm 406, and shaft 402 are rotating through arcs. This prevents lateral stresses generated by the rotation of the linkage 400 from being transmitted to the bellows 110. These lateral stresses can decrease the operating life of the bellows leading to the failure of the interrupter. In addition a stop 510 is provided on the housing 500, preferably adjacent the leg 404, to arrest the motion of the linkage 400 caused by kickout spring 210. This prevents overextension of the bellows 110 as the moveable contact 104 returns to the open position when the contactor is deenergized.

The kickout spring adjustment apparatus can be employed with a variety of vacuum contactors and is not intended for a particular style or manufacture of vacuum contactor. Use of the adjustment apparatus allows for a safe and convenient method of controlling the force of the kickout spring in a vacuum contactor.

I claim:

1. A vacuum contactor, comprising:

vacuum interrupter means for opening and closing an electrical circuit;

operating means for effecting the opening and closing of the vacuum interrupter means, the operating means including a spring for opening the vacuum interrupter means;

spring adjusting means providing for the controllable increase or decrease in the force of the spring thereby allowing for the insertion or removal of the spring in the operating means at a force substantially lower than the operating force of the spring, comprising;

a base;

a U-shaped bracket mounted on the base adjacent the spring and having opposed bores in the legs thereof;

a locking block intermediate the legs of the bracket and inserted in the opposed bores of the bracket;

a lever having a portion thereof in contact with one end of the spring and having one end thereof moveably mounted in the base; and a rod having a shaft and a head, the shaft engaging the locking block, the head engaging the lever with the rod, locking block, bracket and base holding the lever against the force of the spring whereby movement of the rod in one direction moves the lever to increase the force of the spring while movement in the opposite direction moves the lever to decrease force of the spring; and a housing for enclosing and supporting the vacuum interrupter means and the operating means.

2. The apparatus of claim 1 further comprising:

the locking block being rotatable in the opposed bores of the bracket and having a bore therethrough;

the lever being pivotally mounted on the base and having a bore therethrough corresponding to the bore in the locking block allowing the shaft of the rod to pass therethrough and into engagement with the bore of the locking block; and the rod having a head that is larger than the opening of the bore in the lever preventing the head of the rod from passing therethrough with the head in contact with the lever thereby holding the lever against the force of the spring.

3. The apparatus of claim 2 wherein the locking block has a threaded bore therein and a portion of the shaft is threaded, the threaded portion of the shaft engaging the threaded bore of the locking block such that rotation of the rod about the longitudinal axis thereof in one direction causes the lever to increase the force of the spring while rotation of the rod in the opposite direction causes the lever to decrease the force of the spring, the length of the spring changing as the force thereof is increased or decreased moving the lever in an arc with respect to the base and the rod in an arc with respect to the bore in the lever whereby the locking block rotates in the opposed bores of the bracket to accommodate the arcuate movement of the rod engaged therewith.

4. The apparatus of claim 3 wherein a spring seat is provided on the lever adjacent the end of the spring, the spring seat detachably securing the end of the spring to the lever thereby preventing the spring from slipping out from contact with the lever during adjustment in the force of the spring or during opening or closing of the vacuum contactor.

5. The apparatus of claim 4 wherein the locking block has a second threaded bore therein, the second bore intersecting the first bore therein and a set screw threadably engaging the second bore and contacting the shaft of the rod which is engaged with the first bore thereby locking the rod in the locking block preventing the rotation thereof.

6. A vacuum contactor, comprising:

vacuum interrupter means for opening and closing an electrical circuit;

operating means for effecting the opening and closing of the vacuum interrupter means, the operating means including a spring for opening the vacuum interrupter means;

a housing for enclosing and supporting the vacuum interrupter means and the operating means; and spring adjusting means comprising a base;

a U-shaped bracket mounted on the base adjacent the spring and having opposed bores in the legs thereof;

a locking block intermediate the legs of the bracket and inserted in the opposed bores of the bracket;

a lever having a portion thereof in contact with one end of the spring and having one end thereof moveably mounted in the base; and a rod having a shaft and a head, the shaft engaging the locking block, the head engaging the lever with the rod, locking block, bracket and base holding the lever against the force of the spring whereby movement of the rod in one direction moves the lever to increase the force of the spring while movement in the opposite direction moves the lever to decrease force of the spring, providing for the controlled increase or decrease of force in the spring, the spring adjustment means allowing for the insertion or removal of the spring in the operating mechanism at a force substantially lower than the operating force.

7. A vacuum contactor, comprising:

vacuum interrupter means for opening and closing and electrical circuit;

operating means for effecting the opening and closing of the vacuum interrupter means, the operating means including a spring for opening the vacuum interrupter means;

a housing for enclosing and supporting the vacuum interrupter means and the operating means; and spring adjusting means comprising:

a base;

a U-shaped bracket mounted on the base adjacent the spring and having opposed bores in the legs thereof;

a locking block having a threaded bore therethrough and positioned intermediate the legs of the bracket and inserted in the opposed bores of the bracket, the locking block being rotatable in the opposed bores of the bracket;

a lever having a bore therethrough and having one end thereof pivotally mounted on the base, a portion of the lever in contact with one end of the spring; and a rod having a threaded shaft and a head, the shaft passing through the bore in the lever with the threads thereof engaging the threaded bore of the locking block, the head being larger than the opening of the bore in the lever preventing the rod from passing therethrough with the head in contact with the lever, the rod, locking block, bracket, and base holding the lever against the force of the spring whereby the rotation of the rod about the longitudinal axis thereof in one direction causes the lever to increase the force of the spring while rotation of the rod in the opposite direction causes the lever to decrease the force of the spring providing for the controlled increase or decrease of force in the spring, the length of the spring changing as the force thereof is increased or decreased moving the lever in an arc with respect to the base and the rod in an arc with respect to the bore in the lever whereby the locking block rotates in the opposed bores of the bracket to accommodate the arcuate movement of the rod engaged therewith, the spring adjustment means allowing the insertion or removal of the spring in the operating mechanism at a force substantially lower than the operating force of the spring.

8. The apparatus of claim 7 wherein the locking block has a second threaded bore therein, the second bore intersecting the first bore therein and a set screw threadably engaging the second bore and contacting the shaft of the rod which is engaged with the first bore thereby locking the rod in the locking block preventing the rotation thereof.

9. A spring adjustment mechanism for a vacuum contactor having vacuum interrupter means for opening and closing an electrical circuit and operating means for affecting the opening and closing of the vacuum interrupter means, the operating means including a spring for opening the vacuum interrupter means comprising:

a base;

a U-shaped bracket mounted on the base adjacent the spring and having opposed bores in the legs thereof;

a locking block intermediate the legs of the bracket and inserted in the opposed bores of the bracket;

a lever having a portion thereof in contact with one end of the spring and having one end thereof moveably mounted in the base; and a rod having a shaft and a head, the shaft engaging the locking block, the head engaging the lever with the rod, locking block, bracket and base holding the lever against the force of the spring whereby movement of the rod in one direction moves the lever to increase the force of the spring while movement in the opposite direction moves the lever to decrease force of the spring, providing for the controlled increase or decrease of force in the spring.

10. The apparatus of claim 9 further comprising:

the locking block being rotatable in the opposed bores of the bracket and having a bore therethrough;

the lever being pivotally mounted on the base and having a bore therethrough corresponding to the bore in the locking block allowing the shaft of the rod to pass therethrough and into engagement with the bore of the locking block; and the rod having a head that is larger than the opening of the bore in the lever preventing the head of the rod from passing therethrough with the head in contact with the lever thereby holding the lever against the force of the spring.

11. The apparatus of claim 10 wherein the locking block has a threaded bore therein and a portion of the shaft is threaded, the threaded portion of the shaft engaging the threaded bore of the locking block such that rotation of the rod about the longitudinal axis thereof in one direction causes the lever to increase the force of the spring while rotation of the rod in the opposite direction causes the lever to decrease the force of the spring, the length of the spring changing as the force thereof is increased or decreased moving the lever in an arc with respect to the base and the rod in an arc with respect to the bore in the lever whereby the locking block rotates in the opposed bores of the bracket to accommodate the arcuate movement of the rod engaged therewith.

12. The apparatus of claim 11 wherein a spring seat is provided on the lever adjacent the end of the spring, the spring seat detachably securing the end of the spring to the lever thereby preventing the spring from slipping out from contact with the lever during adjustment in the force of the spring or during opening or closing of the vacuum contactor.

13. The apparatus of claim 12 wherein the locking block has a second threaded bore therein, the second bore intersecting the first bore therein and a set screw threadably engaging the second bore and contacting the shaft of the rod which is engaged with the first bore thereby locking the rod in the locking block preventing the rotation thereof.

14. A spring adjustment mechanism for a vacuum contactor having vacuum interrupter means for opening and closing an electrical circuit and operating means for affecting the opening and closing of the vacuum interrupter means, the operating means including a spring for opening the vacuum interrupter means, comprising:

a base;

a U-shaped bracket mounted on the base adjacent the spring and having opposed bores in the legs thereof;

a locking block having a threaded bore therethrough and positioned intermediate the legs of the bracket and inserted in the opposed bores of the bracket, the locking block being rotatable in the opposed bores of the bracket;

a lever having a bore therethrough and having one end thereof pivotally mounted on the base, a portion of the lever in contact with one end of the spring; and a rod having a threaded shaft and a head, the shaft passing through the bore in the lever with the threads thereof engaging the threaded bore of the locking block, the head being larger than the opening of the bore in the lever preventing the rod from passing therethrough with the head in contact with the lever, the rod, locking block, bracket, and base holding the lever against the force of the spring whereby the rotation of the rod about the longitudinal axis thereof in one direction causes the lever to increase the force of the spring while rotation of the rod in the opposite direction causes the lever to decrease the force of the spring providing for the controlled increase or decrease of force in the spring, the length of the spring changing as the force thereof is increased or decreased moving the lever in an arc with respect to the base and the rod in an arc with respect to the bore in the lever whereby the locking block rotates in the opposed bores of the bracket to accommodate the arcuate movement of the rod engaged therewith, the spring adjustment means allowing the insertion or removal of the spring in the vacuum contactor at a force substantially lower than the operating force of the spring.

15. The apparatus of claim 14 wherein a spring seat is provided on the lever adjacent the end of the spring, the spring seat detachably securing the end of the spring to the lever thereby preventing the spring from slipping out from contact with the lever during adjustment in the force of the spring or during opening or closing of the vacuum contactor.

16. The apparatus of claim 14 wherein the locking block has a second threaded bore therein, the second bore intersecting the first bore therein and a set screw threadably engaging the second bore and contacting the shaft of the rod which is engaged with the first bore thereby locking the rod in the locking block preventing the rotation thereof.

* * * * *